United States Patent [19]

Hasak

[11] 4,377,928

[45] Mar. 29, 1983

[54] REINFORCEMENT BASKET FOR REINFORCED-CONCRETE COLUMN

[75] Inventor: Wilhelm Hasak, Pfettrach, Fed. Rep. of Germany

[73] Assignee: Landshuter Baueisenbiegerei GmbH, Altdorf, Fed. Rep. of Germany

[21] Appl. No.: 190,170

[22] Filed: Sep. 23, 1980

[30] Foreign Application Priority Data

Jan. 9, 1980 [DE] Fed. Rep. of Germany ..... 3000605

[51] Int. Cl.[3] ..... E04C 5/06

[52] U.S. Cl. ..... 52/653

[58] Field of Search ..... 52/650, 653, 723; 138/176

[56] References Cited

U.S. PATENT DOCUMENTS

| | | | |
|---|---|---|---|
| 822,587 | 6/1906 | Cummings | 52/653 |
| 1,008,209 | 11/1911 | Skinner | 52/653 |
| 1,096,685 | 5/1914 | Cummings | 52/653 |
| 1,115,490 | 11/1914 | Mogan | 52/652 |
| 1,159,297 | 11/1915 | Turner | 52/653 |
| 2,227,153 | 12/1940 | Prosser | 52/653 |
| 2,660,199 | 11/1953 | Montgomery | 138/176 |

*Primary Examiner*—John E. Murtagh

*Attorney, Agent, or Firm*—Karl F. Ross; Herbert Dubno

[57] ABSTRACT

A reinforced-concrete column reinforcement comprises at least two hoops centered on and spaced apart along an axis and a plurality of deformable holders fixed at angular spacings on these hoops. Respective longitudinal reinforcement bars each extend axially through one of the holders of one of the hoops and through a respective one of the holders of the other of the hoops. The holders grip these bars. A helicoidal wrapping wire generally centered on the axis is welded to axially extending spacer rods fixed to the hoops and surrounds these rods and the reinforcement bars. The holders may be constituted as malleable metal elements welded on the hoops and forming passages through which the reinforcement bars pass. Once these reinforcement bars are fitted through the passages these elements may be deformed into tight clenching contact with the bars.

4 Claims, 9 Drawing Figures

REINFORCEMENT BASKET FOR REINFORCED-CONCRETE COLUMN

FIELD OF THE INVENTION

The present invention relates to a reinforced-concrete column. More particularly this invention concerns a so-called reinforcement basket formed of steel bars and wires that is embedded in such a column.

BACKGROUND OF THE INVENTION

A reinforcement for a reinforced-concrete column normally consists of a plurality of hoops centered on and spaced apart along the longitudinal axis of the column to be produced, and a plurality of longitudinally extending reinforcement bars secured to these hoops. A helical wire wrap surrounds the longitudinal reinforcement bars. The reinforcement bars have to be secured to the hoops at their intersections, and the wire wrap is secured to some of these bars and to the hoops.

As the size of such a reinforcement basket is relatively large, standard practice is to fabricate it on the job. The most preferred practice is to weld the arrangement together, which requires the use of weldable steel such as so-called IIIb ribbed steel bar for concrete reinforcement. This material is relatively expensive and frequently hard to obtain on short notice.

Thus it is standard practice to resort to the use of cheaper nonweldable steel bars, that is bars which cannot readily be welded to the hoops. A connection is therefore made by looping wire around the intersections of the reinforcement bars and the hoops. This is a relatively labor-intensive process which, unfortunately, still does not ensure good positioning of the various elements relative to each other. Frequently when such a prefabricated basket is being lifted into place it deforms somewhat, requiring it to be painstakingly reworked.

OBJECTS OF THE INVENTION

It is therefore an object of the present invention to provide an improved reinforcement for a reinforced-concrete column.

Another object is to provide such a reinforcement which allows relatively easy on-the-job assembly of a reinforcement basket.

A further object is to provide such a reinforcement which uses relatively inexpensive and easy-to-obtain steel reinforcement bars of the type that can normally not be welded.

SUMMARY OF THE INVENTION

These objects are attained according to the instant invention by securing longitudinal reinforcement bars to the hoops by means of deformable holders which are permanently fixed at angular spacings on the hoops. These holders are deformed around the longitudinal reinforcement bars to hold them in place. A helicoidal wrapping wire generally centered on the axis of the assembly is fixed to the hoops and surrounds the bars.

Thus with the system according to the instant invention the longitudinal reinforcement bars are fitted to the holders on the hoops and then the holders are deformed tightly around them, normally by simply striking them with a hammer to bend them into tight contact with the reinforcement bars. The result is an extremely solid connection which can be produced very quickly and, therefore, at very low labor cost. The holders themselves are provided on the reinforcement bars and can easily be mass-produced at low cost.

The wrapping wire is fixed, normally by welding, to axially extending spacer rods which themselves are normally fixed to the hoops by welding. Thus these spacer rods and the wrap wire ensure proper positioning of the various elements of the reinforcement basket to each other. The resultant reinforcement rod, therefore, is extremely strong, yet very easy to assembly.

According to further features of this invention each of the holders has a malleable metal element forming an axially throughgoing passage through which the respective reinforcement bar passes. These elements may be generally U-shaped, having one leg welded to the respective hoop and another leg spaced from the respective hoop. This other leg may be formed with a bumpor barb for securing the respective longitudinal reinforcement bar in place, and may also be formed with a weakened region so that it can be bent over around the respective longitudinal reinforcement bar. In addition the elements may be formed as eyes which are bent closed after the reinforcement bars are inserted through them. Two short upstanding pins may be provided between which the reinforcement bar is fitted, and which may have bumps or barbs for snapping behind the bar, or which may simply be bent down around the bar once it is in place.

Holders such as described above may also be provided on the wrap wire to secure it to the reinforcement bars. In addition these holders may be large enough to accommodate two reinforcement bars so that when a reinforcement basket must be made which is longer than the maximum available bar length, two bars can be inserted through a single holder to form an extra-length assembly.

SPECIFIC DESCRIPTION

Figure 1:
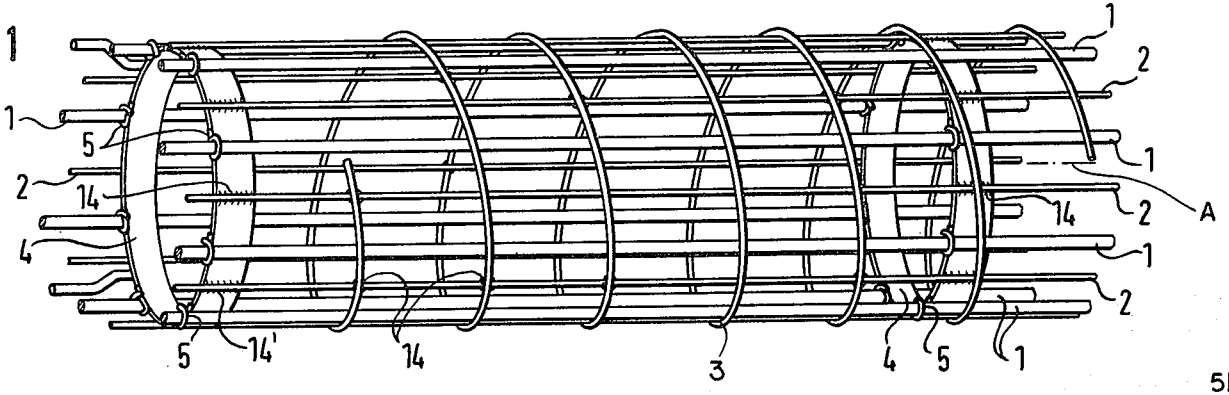
FIG. 1 is a perspective view of a reinforcement basket according to this invention.
Figure 2:
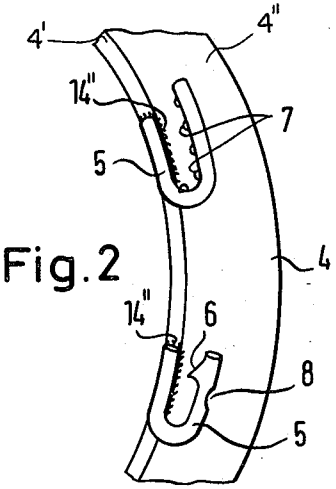
FIG. 2 is a large-scale view of a detail of FIG. 1.

As seen in FIGS. 1 and 2 a plurality of standard ridged steel reinforcement bars 1 extending parallel to a central axis A and to axially extending spacer wires 2 are surrounded by a helicoidal wire wrap 3 that is welded at 14 to the spacer wires 2. Hoops 4 of short cylindrical shape are secured via welds 14' to the holding wires 2 and via holders 5 to the bars 1. The entire assembly is generally cylindrical and centered on the axis A.

As seen in FIG. 2 these holders 5 are U-shaped and secured by means of welds 14" to the end edges 4' of the hoops 4. The outer leg of each holder 5 may be formed either with a barb 6 adjacent a weakened region 8, or with bumps 7. These bars 6 or bumps 7 engage over the bar 1 to lock it in place. It is also within the scope of this invention to plastically deform the outer leg around the bar 1 after it is in place in the manner shown in FIG. 1.

Figure 3:
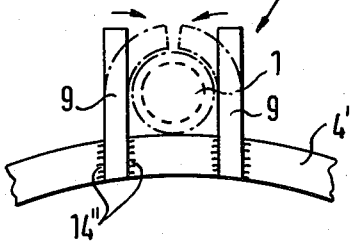

FIG. 3 shows a holder 5*a* comprising a pair of upstanding pins 9 welded at 14″ to the end edge 4′ and delivered to the user standing radially up. Once the bar 1 is in place the outer ends of these pins 9 are bent over. FIG. 3 also shows how the bar 1 might be tubular.

Figure 4:
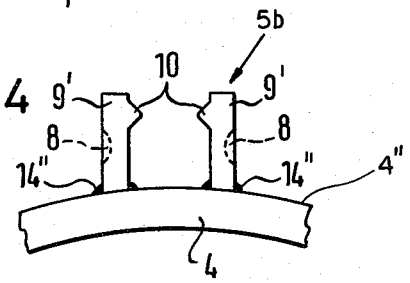
FIGS. 3–5 are end views of holders according to this invention.

In FIG. 4 a holder 5*b* is shown having a pair of upstanding pins 9′ welded to the outer cylindrical face 4″ of the hoop 4. These pins 9′ have adjacent their outer ends inwardly directed bumps 10 and are formed inwardly therefrom with weakened regions or recesses 8 so that they can be deflected outwardly by the rod 1 when it is forced between them.

Figure 5:
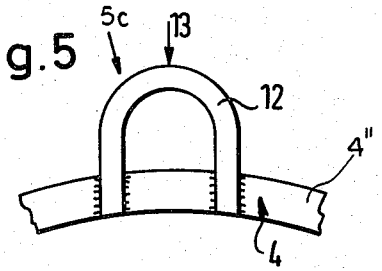

In FIG. 5 a holder 5*c* is formed as a simple U-shaped hoop or eye 12 which can be deformed plastically inwardly by striking in the direction shown by arrow 13 to tightly grip a bar 1. The legs of this U-shaped eye 12 are both welded to the end edge 4″ of the hoop 4.

Figure 6:
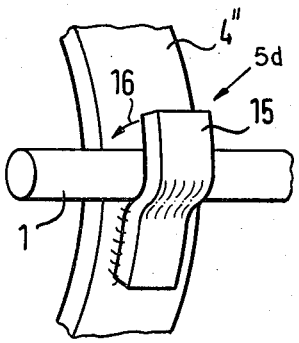
FIG. 6 is a perspective view of a holder according to this invention.

In FIG. 6 a flat metallic element 15 is welded once again to the outer face 4″ of the hoop 4 to constitute a holder 5*d*. The free end of this element 15 is hammered over as shown at 16 once the reinforcement rod 1 has been inserted through it.

Figure 7:
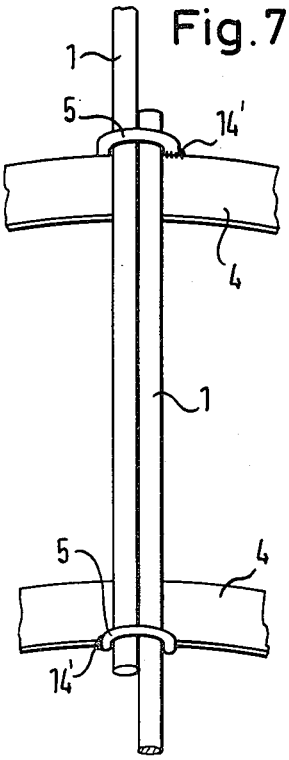
FIG. 7 is a side view showing how an over-long assembly can be made according to this invention.
Figure 8:
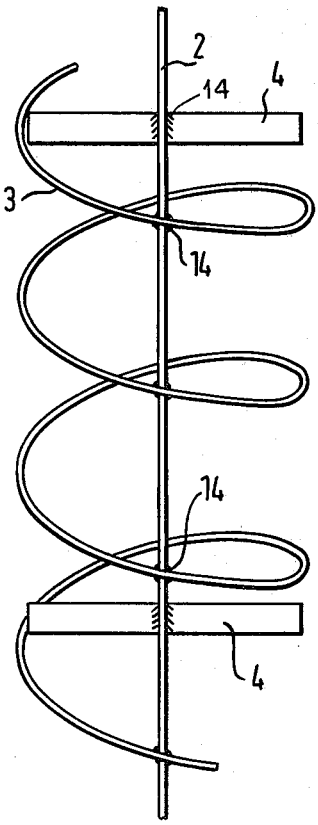
FIG. 8 is a side view of the wrap-wire assembly according to this invention.

FIG. 7 shows how an extra-long basket can be made by inserting two bars 1 through each of the holders 5. These holders 5 can then be clenched around the bars 1 so as to produce a basket having a length that can be substantially longer than that of the longest rod 1.

Figure 9:
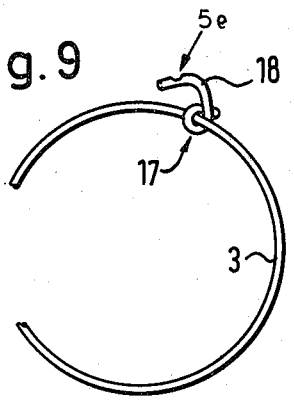
FIG. 9 is an end view of a variant of the arrangement of FIG. 8.

FIG. 9 shows how the wire wrap 3 is welded to the holding bars 2 and how these bars 2 are in turn welded at 14 to the hoops 4. This welding is possible because the material of the elements 2, 3, and 4 is of a readily weldable steel, whereas the material of the bars 1 is not.

Finally, FIG. 9 shows a turn of the wire wrap 1 which is provided with the holder 5*e* constituted as a malleable iron wire having one end 17 wrapped tightly around the wire 3 and another end 18 forming a passage like the holder 5 of FIG. 1. This arrangement, therefore, allows the reinforcement bars 1 to be tightly secured also to the wrap wire 3.

The system according to the instant invention, therefore, allows a reinforcement basket to be fabricated on the job with relative ease. Nonweldable bars 1 can be used, yet the onerous process of securing them in place to the other weldable parts of the structure is eliminated by providing holders on the hoops 4 as well as if desired on the turns of the wire 3. The finished assembly is extremely rigid so that it can be handled by a crane without fear of its deforming or coming apart.

I claim:

1. A reinforced-concrete column reinforcement comprising:

two hoops centered on and spaced apart along an axis;

a plurality of malleable metal holders welded at angular spacings on said hoops and each forming an axially throughgoing passage, said holders being each generally U-shaped, having one leg welded to the respective hoop and another leg spaced from the respective hoop;

respective longitudinal reinforcement bars each extending axially through the passage of a respective one of said holders of one of said hoops and through the passage of a respective one of said holders of the other of said hoops, said holders gripping and at least partially surrounding said bars; and a helicoidal wrapping wire generally centered on said axis, fixed to said hoops, and surrounding said bars.

2. The reinforcement defined in claim 1 wherein each of said other legs has a bump directed toward the respective one leg.

3. The reinforcement defined in claim 1 wherein each of said other leg is formed with a barb.

4. The reinforcement defined in claim 1 wherein each of said other legs is formed with a weakened region, whereby said other legs can be bent over around the respective bars at the respective weakened regions.

* * * * *